US007310928B2

(12) United States Patent
Curry

(10) Patent No.: US 7,310,928 B2
(45) Date of Patent: Dec. 25, 2007

(54) RETRACTABLE SPURS

(76) Inventor: Janine V. Curry, 26880 Via Terraza, Saugus, CA (US) 91350

( * ) Notice: Subject to any disclaimer, the term of this patent is extended or adjusted under 35 U.S.C. 154(b) by 206 days.

(21) Appl. No.: 11/161,904

(22) Filed: Aug. 22, 2005

(65) Prior Publication Data

US 2006/0042201 A1 Mar. 2, 2006

Related U.S. Application Data

(60) Provisional application No. 60/604,306, filed on Aug. 24, 2004.

(51) Int. Cl.
*A43C 17/06* (2006.01)

(52) U.S. Cl. ..... 54/83.2

(58) Field of Classification Search ..... 54/49.5, 54/83.1, 83.2; D30/157
See application file for complete search history.

(56) References Cited

U.S. PATENT DOCUMENTS

| | | | | | |
|---|---|---|---|---|---|
| 82,921 | A | | 10/1868 | Cooper | |
| 198,010 | A | * | 12/1877 | Elliott | 54/83.2 |
| 376,832 | A | | 1/1888 | Schummel | |
| 655,555 | A | | 8/1900 | Jackson | |
| 929,099 | A | * | 7/1909 | Muth | 54/83.2 |
| 931,063 | A | * | 8/1909 | Hayes | 54/83.2 |
| 973,367 | A | * | 10/1910 | McKinney | 54/83.1 |
| 1,351,619 | A | * | 8/1920 | Calderon | 54/83.2 |
| 3,153,888 | A | | 10/1964 | Garrett | |
| 3,157,013 | A | | 11/1964 | Hayward et al. | |
| 3,953,958 | A | | 5/1976 | Beaston | |
| 4,443,996 | A | | 4/1984 | Welton et al. | |
| 4,501,110 | A | | 2/1985 | Kibler | |
| 4,513,561 | A | | 4/1985 | Welton et al. | |
| 4,642,910 | A | | 2/1987 | Carter | |
| D289,809 | S | | 5/1987 | Pela | |
| D352,805 | S | | 11/1994 | Martin | |
| D362,928 | S | | 10/1995 | Redden | |
| D383,257 | S | | 9/1997 | Clark | |
| D437,980 | S | | 2/2001 | Anderson | |
| 6,192,663 | B1 | | 2/2001 | Gatlin et al. | |
| 6,339,915 | B1 | | 1/2002 | Bradbury | |
| 6,353,980 | B1 | | 3/2002 | Sprenger et al. | |
| 6,381,931 | B2 | | 5/2002 | Balkenhol | |
| D459,558 | S | | 6/2002 | Martin | |
| 6,536,196 | B2 | | 3/2003 | Harrison et al. | |

* cited by examiner

*Primary Examiner*—Rob Swiatek
(74) *Attorney, Agent, or Firm*—Kelly Lowry & Kelley, LLP

(57) ABSTRACT

A spur system including a body having arms adapted to extend on either side of a heel of a footwear, such as a boot. A nib is pivotally coupled to the body, and selectively moveable between an activated and an unactivated position.

14 Claims, 3 Drawing Sheets

RETRACTABLE SPURS

RELATED APPLICATION

This application claims priority to U.S. provisional application, Ser. No. 60/604,306, filed Aug. 24, 2004.

BACKGROUND OF THE INVENTION

The present invention generally relates to spur systems. More particularly, the present invention relates to a retractable spur which can be selectively moved into use and non-use positions while retaining the spur on the rider's boot.

Spur systems may comprise a spur body for attaching the assembly to a shoe or boot of the rider, and a spur nib attached to the spur body, where the spur nib may be the part of the spur used to control an animal, such as a horse.

A spur body may comprise a generally U-shaped configuration, which may fit around the heel of the rider's boot. Each arm of the body may have an orifice at one end configured to receive a strap. The strap can be fastened around the foot section of the boot, thus providing a configuration for removably attaching the spur system to the boot. The spur system may further comprise a projection, or nib, extending perpendicularly from the middle of the outer surface of the curved section of the spur body.

Sometimes a rider or user may ride a horse for which a spur is needed, and some times a spur may not be needed. This may not be determined until the rider is mounted on the horse, or at different times during a ride. If spurs are not needed a rider may have to remove the spurs so that they are non-functional, which may be cumbersome and time consuming. Furthermore, the rider must then store the removed spur either on the horse or at another location. This may also be cumbersome, and may increase the likelihood that the spurs will be lost.

Accordingly, what is needed is a spur system that may be rendered non-functional without removal of the entire system from the boot of a user. The present invention fulfills these needs and provides other related advantages.

SUMMARY OF THE INVENTION

The present invention resides in a spur system which includes a selectively positionable nib portion (sometimes referred to in the art as the "spur"). The spur system generally comprises a body that would be removably attached to a footwear. The body typically includes arms adapted to extend on either side of a heel of a boot. As such, the body is generally U-shaped. A strap may be used to attach the body securely to the footwear.

A nib is coupled to the body and selectively movable between an activated an unactivated position. Preferably, the nib is pivotally coupled to the body. A biasing member, such as a spring, is associated with the body and the nib to bias the nib into a non-moving position. Typically, a pin extends through the nib and is coupled to the body to facilitate pivotal movement of the nib. The biasing member, which may comprise a coiled spring disposed over the pin and adjacent to the nib, biases the nib laterally within a receiving portion of the body such that the nib is in a non moving position.

In order to move the nib from an unactivated position to an activated position, the user pushes the nib laterally to within a receiving portion of the body which allows pivotal movement of the nib, pivots the nib, and releases the nib so that the spring biases the nib into the non-moving position receiving portion of the body. The same steps are taken to remove the nib from an activated or outwardly projecting position to an inactivated or inwardly directed position. This can be accomplished without having to remove the nib, or having to remove the spur body from the footwear.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF PREFERRED EMBODIMENTS

The detailed description set forth below in connection with the appended drawings is intended as a description of exemplary embodiments and is not intended to represent the only forms in which these embodiments may be constructed and/or utilized. The description sets forth the functions and the sequence of steps for constructing and operating the exemplary embodiments. However, it is to be understood that the same or equivalent functions and sequences may be accomplished by different embodiments that are also intended to be encompassed within the spirit and scope of the invention.

Figure 1:
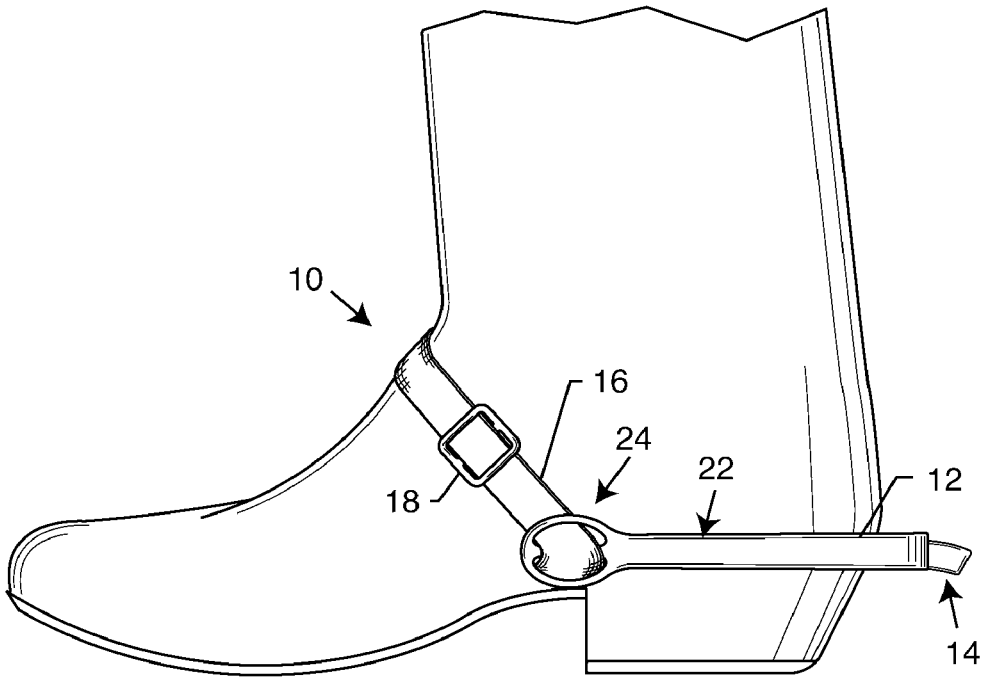
FIG. 1 is a perspective view of a spur system according to an exemplary embodiment, with a nib portion in an activated position.
Figure 1A:
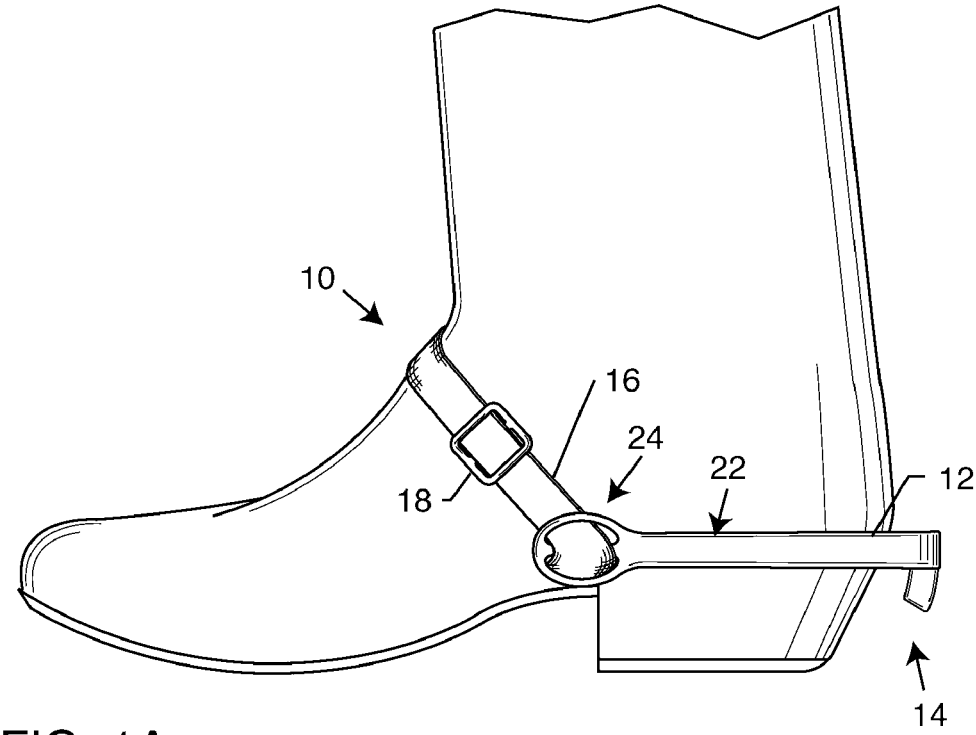
FIG. 1A is a perspective view of a spur system according to an exemplary embodiment, with a nib portion in an unactivated position.

As shown in the accompanying drawings, for purposes of illustration, the present invention resides in a retractable spur system, generally referred to by the reference number 10. As shown in FIG. 1, system 10 may include a body portion 12, which may be moveably coupled to a nib portion 14. System 10 may also include a strap 16 and a buckle 18 which may be configured to couple to body portion 12 via orifice 24. Body portion 12 may also include one or more arm portions 22, which may be configured to extend along each side of a user's footwear, such as a boot or shoe. With this configuration, the system may be releasably coupled to a user.

Furthermore, with a moveable coupling configuration between nib 14 and body portion 12 may allow nib portion 14 to move from an activated position to an unactivated position and vice versa. With this configuration, a user may move nib 14 from an activated to an unactivated position without removing the entire system from their boot and/or body. This may be advantageous as the user may lose or misplace the system once removed. Furthermore, this system may be useful in that the user may put on the spur system at the beginning of the day, and if not needed, may move nib portion from an activated to an unactivated position somewhat easily while remaining on the animal. Furthermore, as nib 14 may be permanently connected to body portion 12, no portions of the system may be lost, as they may not need to be removed from other parts of the system.

Figure 2:
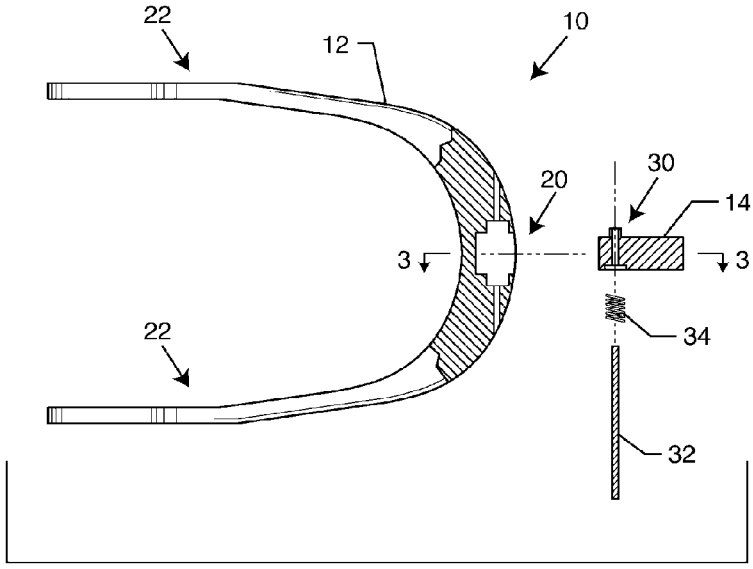
FIG. 2 is an exploded top view of an exemplary embodiment of a spur system.

FIG. 2 shows a top exploded view of a system 10 according to an exemplary embodiment. System 10 again includes a body portion 12 and a nib portion 14 which may be moveably coupled to each other. Body portion 12 may include one or more arms 22 that may extend on either side of the user's boot, shoe, foot or other body portion, as desired. Body portion 12 may also include a receiving configuration 20 which may be configured to receive an adapting portion 30 of nib 14. Furthermore, nib 14 may be moveably coupled to body portion 12 via a pin 32 and biasing member 34.

As shown, nib 14 may not move longitudinally due to the receiving configuration 20 and adapting portion 30 unless a lateral force is applied to disengage them. Then nib 14 may move longitudinally with respect to body portion 12 such that it may move from an activated position to an unactivated position or deactivated position. Biasing member 34 may bias nib 14 laterally with respect to body portion 12 such that it will engage body portion 12 and generally be not movable or pivotable in either the activated or deactivated position. With this configuration, a user may apply lateral force to disengage the nib 14 from the body portion 12, and then move or rotate nib 14 with respect to body portion 12 somewhat easily and may move nib 14 from the activated to de-activated position and vice versa while still mounted on the animal without much difficulty.

Figure 3:
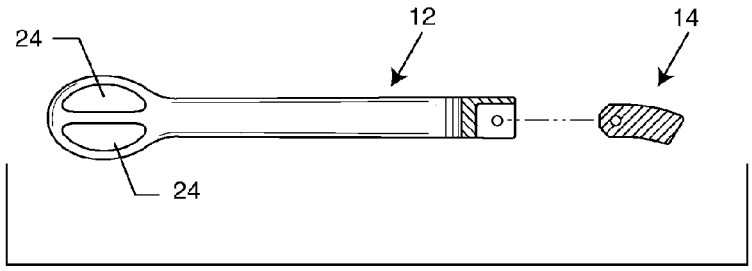
FIG. 3 is a side elevational view of the embodiment of FIG. 2.

FIG. 3 shows the side elevational view of a body portion 12 and a nib portion 14 with nib portion 14 generally in the activated position. Body portion 12 may include one or more orifices 24 which may be configured to couple to strap 16 such that the system may be coupled to the user.

Figure 4:
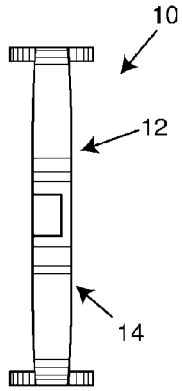
FIG. 4 is an end elevational view of the embodiment of FIG. 2.

FIG. 4 shows an end elevational view of the system 10 with the nib 14 in the activated position and extending outwardly or inwardly with respect to the plane of the page of the figure.

Figure 5:
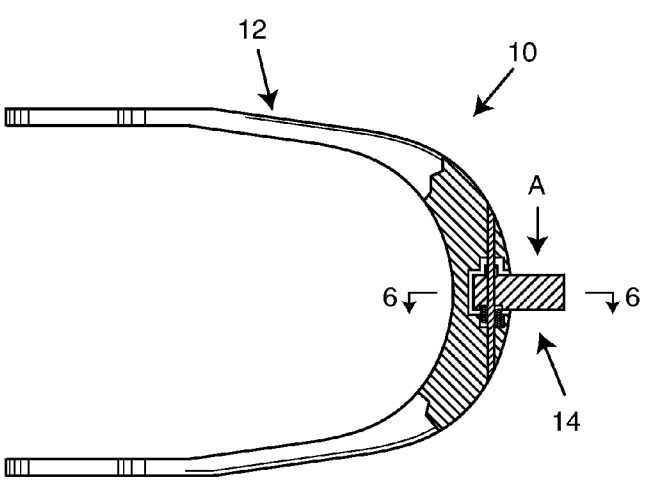
FIG. 5 is a top elevational view of an exemplary embodiment of a spur system, with a nib portion in the activated position.

FIG. 5 shows a top elevational view of the system 10 with nib 14 in the activated position with respect to body portion 12. As shown by directional arrow A, if a lateral force is applied to nib 14 it may disengage from body portion 12 such that it may move and/or rotate with respect to body portion 12 from the activated to the de-activated position and vice versa, as needed and/or as desired.

Figure 6:
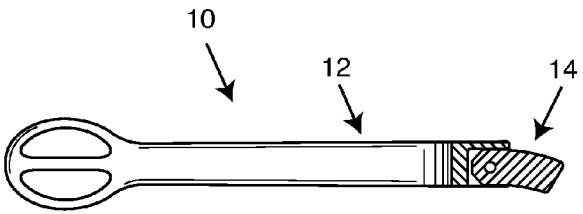
FIG. 6 is a side elevational view of the embodiment of FIG. 5.

FIG. 6 shows a side elevational view of a system 10 according to an exemplary embodiment with nib portion 14 in the activated position and coupled to body portion 12.

Figure 7:
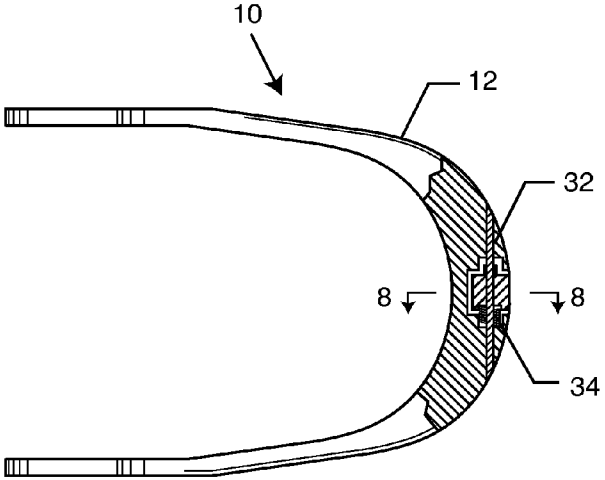
FIG. 7 is a top elevational view of an exemplary embodiment of a spur system, with a nib portion in an unactivated position.

FIG. 7 is a top view of a retractable spur system 10 according to an exemplary embodiment with nib portion 14 in the unactivated position with respect to body portion 12. As shown, a pin extends through nib 14 a portion of body portion 12 to moveably couple them. Furthermore, as shown biasing member 34 biases nib 14 laterally with respect to body portion 12 such that they generally fixedly couple each other.

Figure 8:
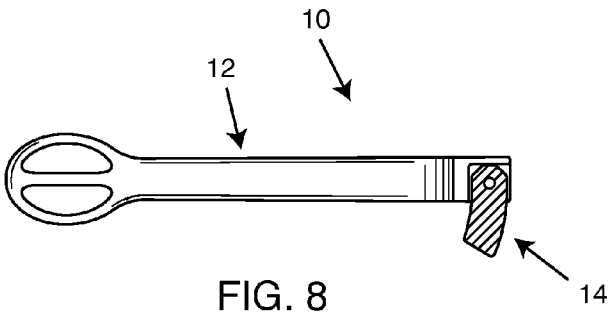
FIG. 8 is a side elevational view of the embodiment of FIG. 7.

FIG. 8 shows a side elevational view of a system 10 according to an exemplary embodiment with nib 14 in the unactivated position with respect to body portion 12. Once the lateral force has been applied to move nib 14 laterally with respect to body portion 12 then a force along directional arrow B may be utilized to move nib 14 from an unactivated position to an activated position with respect to body portion 12.

Figure 9:
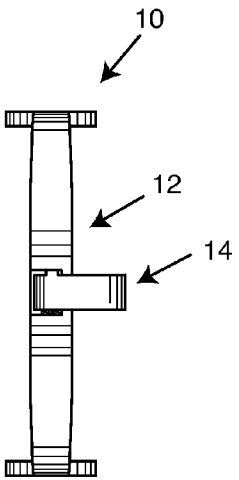
FIG. 9 is an end elevational view of the embodiment of FIG. 7.

FIG. 9 shows an end elevational view of system 10 with nib 14 in the unactivated position with respect to body portion 12. Body portion 12 of system 10 is typically made of a metal alloy. However, it will be appreciated that other materials may be utilized in part or in combination as desired without straying from the concepts disclosed herein. Furthermore, nib portion 14 may be made from metal or metal alloys, however, other materials such as plastics, woods, polymers, and/or combinations thereof may also be utilized without straying from the concepts disclosed herein. Although biasing member 34 is shown as a coil spring, it will be appreciated that other biasing configurations may be utilized as desired, without straying from the concepts disclosed herein. Pin 32 is typically made from metals and/or metal alloys but also may be made from other materials such as plastics, woods, metals, polymers and/or combinations thereof without straying from the concepts disclosed herein.

Although a pin and spring biasing, movable, coupling is shown between nib 14 and body portion 12, it will be appreciated that other configurations for a coupling may be utilized without straying from the concepts disclosed herein.

Although nib 14 is shown generally as a sloping, somewhat rectangular configuration, it will be appreciated that many different configurations and designs for a nib portion may be utilized within this system, without straying from the concepts disclosed herein. Furthermore, it will be appreciated that having a nib portion movable with respect to body portion 12 ensures that no parts are removable or will not be inadvertently removed and/or lost from the system during use. Furthermore, if nib 14 does not become disengaged and/or pin 32 and/or biasing member 34 is lost, it may be easily replaced without replacing the entire system which may make the system very versatile and desirable to potential purchasers.

Body portion 12 may be three to six inches in length and 0.2 to 1.5 inches in height. Furthermore, arms 22 may be two to four inches apart at the ends. Nib 14 may be 0.5 -2.0 inches in length. However, it will be appreciated that many sizes and shapes for the different portions of the system may be utilized as desired without straying from the concepts disclosed herein.

In closing, it is to be understood that the embodiments described herein are illustrative of the principles of the present invention. Other modifications that may be employed are within the scope of the invention. Other modifications that may be employed are within the scope of the invention. Thus, by way of example, but not of limitation, alternative configurations may be utilized in accordance with the teachings herein. Accordingly, the drawings and description are illustrative and not meant to be a limitation thereof, and the invention is only limited by the appended claims.

What is claimed is:

1. A spur system, comprising:

a body adapted to be removably attached to a footwear;

a nib coupled to the body and selectively movable between an activated and an unactivated position;

a pin extending through the nib and coupled to the body to facilitate pivotal movement of the nib; and a biasing member adanted to bias the nib into a nonmovinci position within a body receiving portion;

wherein the biasing member comprises a coil spring disposed over the pin and adiacent to the nib.

2. The spur system of claim 1, wherein the body includes arms adapted to extend on either side of a heel of a boot.

3. The spur system of claim 2, wherein the body is generally U-shaped.

4. The spur system of claim 1, including a strap attachable to the body for securing the body to the footwear.

5. The spur system of claim 1, wherein the nib is pivotally coupled to the body.

6. The spur system of claim 5, wherein the a biasing member operably is associated with the body and the nib so as to bias the nib into the nonmoving position.

7. The spur system of claim 6, wherein the a spring is adapted to bias the nib laterally within the receiving portion of the body.

8. A spur system, comprising:

a generally U-shaped body adapted to be removably attached to heel of a boot;

a nib pivotally coupled to the body and selectively movable between an activated and an unactivated position;

a biasing member operably associated with the body and the nib so as to bias the nib into a nonpivoting position; and a pin extending through the nib and coupled to the body to facilitate pivotal movement of the nib;

wherein the biasing member comprises a coil spring disposed over the pin and adiacent to the nib.

9. The spur system of claim 8, wherein the body includes arms adapted to extend on either side of a heel of a boot.

10. The spur system of claim 9, including a strap attachable to the body for securing the body to the footwear.

11. The spur system of claim 9, wherein the spring is adapted to bias the nib laterally within a receiving portion of the body.

12. A spur system, comprising:

a generally U-shaped body adapted to be removably attached to heel of a boot;

a nib at least partially disposed within a receiving portion of the body;

a pin extending through the nib and coupled to the body to permit selective pivoting of the nib about the pin; and a coil spring disposed over the pin and adjacent to the nib to bias the nib into a nonpivoting position within the receiving portion of the body.

13. The spur system of claim 12, wherein the body includes arms adapted to extend on either side of a heel of a boot.

14. The spur system of claim 12, including a strap attachable to the body for securing the body to the footwear.

* * * * *